US012747520B2

(12) United States Patent
Fan et al.

(10) Patent No.: US 12,747,520 B2
(45) Date of Patent: Sep. 29, 2026

(54) PILE YARN, PREPARATION METHOD AND APPLICATION THEREOF

(71) Applicant: JIANGSU HENGLI CHEMICAL FIBRE CO., LTD., Wujiang (CN)

(72) Inventors: Hongwei Fan, Wujiang (CN); Fangming Tang, Wujiang (CN); Lili Wang, Wujiang (CN); Xiufeng Yu, Wujiang (CN); Cunhong Wei, Wujiang (CN); Yuanhua Zhang, Wujiang (CN); Qi Chen, Wujiang (CN); Xiaoyu Wang, Wujiang (CN)

(73) Assignee: JIANGSU HENGLI CHEMICAL FIBRE CO., LTD., Wujiang (CN)

( * ) Notice: Subject to any disclaimer, the term of this patent is extended or adjusted under 35 U.S.C. 154(b) by 0 days.

(21) Appl. No.: 18/846,671

(22) PCT Filed: Nov. 3, 2022

(86) PCT No.: PCT/CN2022/129391

§ 371 (c)(1),
(2) Date: Sep. 13, 2024

(87) PCT Pub. No.: WO2023/173762

PCT Pub. Date: Sep. 21, 2023

(65) Prior Publication Data

US 2025/0223734 A1 Jul. 10, 2025

(30) Foreign Application Priority Data

Mar. 15, 2022 (CN) ..... 202210255947.1

(51) Int. Cl.
*D02G 3/34* (2006.01)
*D01H 4/02* (2006.01)
(Continued)

(52) U.S. Cl.
CPC ..... *D02G 3/34* (2013.01); *D01H 4/02* (2013.01); *D02G 3/04* (2013.01); *D02G 3/38* (2013.01);
(Continued)

(58) Field of Classification Search
CPC .. D02G 3/00; D02G 3/04; D02G 3/22; D02G 3/24; D02G 3/283; D02G 3/285;
(Continued)

(56) References Cited

U.S. PATENT DOCUMENTS 3,104,516 A * 9/1963 Field, Jr. ..... D02G 1/16 57/208
3,517,498 A * 6/1970 Burellier ..... D02G 3/34 57/208
(Continued)

FOREIGN PATENT DOCUMENTS

CN 106192108 A 12/2016
CN 108796718 A 11/2018
(Continued)

OTHER PUBLICATIONS

How does the quality of cotton (e.g., long-staple vs. short-staple) affect the resulting fabric?, Textimes, Mar. 20, 2025, https://textimes.com/how-does-the-quality-of-cotton-e-g-long-staple-vs-short-staple-affect-the-resulting-fabric/, last visited Oct. 22, 2025. (Year: 2025).*
(Continued)

*Primary Examiner* — Patrick J. Lynch
(74) *Attorney, Agent, or Firm* — Bayramoglu Law Offices LLC

(57) ABSTRACT

A pile yarn, preparation method and application thereof are provided. The method includes: in the process of uniform motion of multifilaments, using the high-pressure airflow to feed short fibers into the fiber transfer channel of multifilaments to prepare the pile yarn; the number of monofilaments
(Continued)

in the multifilament is 30-50; the pressure of the high-pressure airflow is 1-2 MPa; the included angle of 85-90° is formed between the feeding direction of the short fibers and the transferring direction of the multifilaments; the average length of short fibers exposed from the outermost monofilament surface of the multifilament in the prepared pile yarn is 3-5 mm. The application includes: using the pile yarn as all or part of the raw material, processing according to the general processing technology to prepare the pile fabric; the general processing technology is a technology which does not contain an electrostatic flocking or pile cutting procedure.

7 Claims, 5 Drawing Sheets

(51) Int. Cl.

| | |
|---|---|
| ***D02G 3/04*** | (2006.01) |
| ***D02G 3/38*** | (2006.01) |
| ***D03D 13/00*** | (2006.01) |
| ***D03D 15/217*** | (2021.01) |
| ***D03D 15/225*** | (2021.01) |
| ***D03D 15/47*** | (2021.01) |
| ***D03D 15/49*** | (2021.01) |
| ***D03D 27/04*** | (2006.01) |
| ***D04B 1/14*** | (2006.01) |

(52) U.S. Cl.
CPC ..... *D03D 13/008* (2013.01); *D03D 15/217* (2021.01); *D03D 15/225* (2021.01); *D03D 15/47* (2021.01); *D03D 15/49* (2021.01); *D03D 27/04* (2013.01); *D04B 1/14* (2013.01); *D10B 2201/02* (2013.01); *D10B 2201/24* (2013.01)

(58) Field of Classification Search
CPC ..... D02G 3/34; D02G 3/38; D02G 3/408; D02G 3/42; D02G 1/16; D02G 1/162; D02G 1/168
See application file for complete search history.

(56) References Cited

U.S. PATENT DOCUMENTS

| | | | | | |
|---|---|---|---|---|---|
| 3,715,878 | A * | 2/1973 | Kim | D02G 3/42 | 57/24 |
| 3,953,962 | A * | 5/1976 | Breen | D02G 1/168 | 57/350 |
| 4,059,950 | A * | 11/1977 | Negishi | D02G 1/0286 | 57/208 |
| 4,316,311 | A * | 2/1982 | Feffer | D02G 1/00 | 28/248 |
| 4,334,401 | A * | 6/1982 | Bahia | D02G 1/0246 | 57/331 |
| 4,403,470 | A * | 9/1983 | Nelson | D02G 3/22 | 57/5 |
| 4,802,330 | A * | 2/1989 | Yngve | D02G 3/445 | 57/238 |
| 5,027,594 | A * | 7/1991 | Gamberoni | D02G 3/42 | 66/9 B |
| 5,640,745 | A * | 6/1997 | Bertsch | D02G 3/22 | 57/208 |
| 5,732,541 | A * | 3/1998 | Kunzelman | D07B 5/00 | 87/5 |
| 2008/0040906 | A1* | 2/2008 | Earley | D02G 3/42 | 139/395 |
| 2019/0233983 | A1* | 8/2019 | Katsube | B68G 11/02 | |
| 2023/0193524 | A1* | 6/2023 | Shibata | D02G 3/42 | 57/24 |

FOREIGN PATENT DOCUMENTS

| | | | | |
|---|---|---|---|---|
| CN | 111850748 | A | 10/2020 | |
| CN | 113106596 | A | 7/2021 | |
| CN | 113981575 | A | 1/2022 | |
| GB | 2051165 | A * | 1/1981 | D02G 3/402 |
| JP | H08246282 | A | 9/1996 | |

OTHER PUBLICATIONS

Environmental benign natural fibre reinforced thermoplastic composites: A Review, Awais et al., Composites Part C: Open Access 4 (2021) 100082, Elsevier (https://www.sciencedirect.com/science/article/pii/S2666682020300827) (Year: 2021).*

* cited by examiner

PILE YARN, PREPARATION METHOD AND APPLICATION THEREOF

CROSS REFERENCE TO THE RELATED APPLICATIONS

This application is the national phase entry of International Application No. PCT/CN2022/129391, filed on Nov. 3, 2022, which is based upon and claims priority to Chinese Patent Application No. 202210255947.1, filed on Mar. 15, 2022, the entire contents of which are incorporated herein by reference.

TECHNICAL FIELD

The present invention belongs to the field of spinning products and technology, and more particularly, relates to a pile yarn, preparation method and application thereof.

BACKGROUND

Pile fabrics are known for rich pile, soft feel, smooth elasticity, soft luster and other style features, and the pile fabric has good heat retention. Commonly used methods for fabric piling are electrostatic flocking or pile cutting.

Electrostatic flocking is a technical method commonly used in the textile industry, mainly relying on the effect of high-voltage electric field to plant the pile on the adhesives of the fabric surface. It is costly, requires chemical treatment, and is not environmentally friendly.

The method of pile cutting is to design the fabric to have two weft yarn systems during weaving, one system of weft yarns as the base fabric, and the other system of weft yarns as the pile surface. Later, the pile cutting method is used to make it into a pile fabric. The weaving process of this method is relatively complicated, the mechanical and physical properties of the fabric, appearance characteristics and feel of the fabric, the bonding fastness of pile, and the smoothness of pile cutting are directly related to the weaving quality of the ground tissue.

Therefore, it is of great importance to study a pile yarn with a simple processing mode, and a preparation method and application thereof.

SUMMARY

In view of the problems existing in the prior art, the present invention breaks through the limitation that the pile fabric can only be woven by electrostatic flocking and pile cutting, and provides a pile yarn, preparation method and application thereof.

To this end, the technical schemes of the invention are as follows:

A method for preparing a pile yarn, comprising: in a process of uniform motion of multifilaments, using a high-pressure airflow to feed short fibers into a fiber transfer channel of multifilaments to prepare the pile yarn;

wherein a number of monofilaments in the multifilament is 30-50; when the number of monofilaments in the multifilament is too small, it is not possible to make short fibers and monofilaments in the multifilament wrap and interlace with each other, and then short fibers cannot form a good bonding fastness with monofilaments in the multifilament, so the pile cannot be formed;

wherein a pressure of the high-pressure airflow is 1-2 MPa;

wherein an included angle of 85-90° is formed between a feeding direction of short fibers and a transferring direction of multifilaments.

In the process of uniform motion of multifilaments, using the high-pressure airflow to feed short fibers into the fiber transfer channel of multifilaments, under the action of the airflow, monofilaments in the multifilaments in the fiber transfer channel of multifilaments will be entangled and transferred with each other, and will be combined with short fibers in the process of entanglement and transfer, thereby forming the pile yarn. The key to form pile yarn lies in the action of airflow, the high-pressure airflow injected into the fiber transfer channel of multifilaments must meet two roles: one is to make monofilaments blow in the multifilaments and entangle with each other under the action of the airflow; the other is to make the fed short fibers intersperse with the monofilaments in the multifilaments in the process of blowing and entangling of the monofilaments, and make the central axis of the short fiber multifilaments rotate, increasing bonding fastness of short fibers and multifilaments, so that the pile yarn with better bonding fastness can be made. Therefore, the angle between the feeding direction of the short fibers (i.e., the direction of the airflow) and the transferring direction of the multifilaments needs to meet certain conditions; if the angle is too small, the interpenetration between the short fibers and the multifilaments will be insufficient, and the quality and the bonding fastness of the prepared pile yarn will be insufficient; if the angle is too large, the moving direction of the short fibers will be opposite to the moving direction of the multifilaments, which will make it difficult to achieve the effect of the pile. Therefore, the included angle is controlled to be 85-90° between the feeding direction of the short fibers and the transferring direction of the multifilaments. Similarly, the pressure of the high-pressure airflow also needs to meet certain conditions; if the pressure is too small, the monofilaments in the multifilaments and the short fibers are subjected to small airflow force, and the interpenetration and entanglement are insufficient, so that the prepared pile yarn has insufficient bonding fastness of the pile, the quality of the pile yarn is poor, and the pile effect is not good; if the pressure is too large, it will cause energy loss and a waste of energy, which is not conducive to save costs for enterprises.

The following preferred technology program is presented to give a detailed description for this invention.

The said method for preparing a pile yarn, wherein the multifilament is a draw textured yarn (DTY); wherein a specification of the draw textured yarn is 100-150D/30-50F.

The said method for preparing a pile yarn, wherein a speed of uniform motion is 20-40 m/min. The speed of uniform motion of multifilaments is related to the density of the pile, the uniformity of the pile, and the yield of the pile yarn, etc. The present invention controls the speed of uniform motion to be 20-40 m/min, which not only avoid the pile quality of the pile yarn being difficult to control due to the speed of uniform motion of multifilaments being too fast, but also to avoid the yield being low due to the speed of uniform motion of multifilaments being too slow.

The said method for preparing a pile yarn, wherein a total feeding amount of short fibers is 80-130/s (i.e., the number of strands fed per second), the feeding amount of short fibers directly affects the density of the pile in the pile yarn, so that setting the total feeding amount in this way cannot only avoid that the density of the pile being too low due to the small feeding amount, which results in a bad effect of the pile, but also prevent short fibers from blocking the channel due to excessive feeding amount; wherein an average length of short fibers is 15-25 mm.

The said method for preparing a pile yarn, wherein the short fiber is a cotton fiber, a viscose fiber, a polyester fiber or a wool fiber.

The said method for preparing a pile yarn, wherein the fiber transfer channel of multifilaments has a total of n groups of short fiber feeding points arranged at intervals along a length direction of the fiber transfer channel of multifilaments, wherein n is 4-5, each group contains 5-8 short fiber feeding points, the short fiber feeding points of the same group are evenly distributed around a central axis of the fiber transfer channel of internal multifilaments, and a distance between two adjacent groups of short fiber feeding points is 25-30 mm, the said "total feeding amount" is the sum of the feeding amounts of all the short fiber feeding points.

The said method for preparing a pile yarn, wherein the feeding is a continuous or discontinuous feeding; when the feeding is continuous, the short pile on the surface of the pile yarn is continuously distributed; when the feeding is discontinuous, the short pile on the surface of the pile yarn is discontinuously distributed.

The present invention also provides a pile yarn prepared by any one of above methods, wherein the pile yarn mainly consists of the multifilament and piles on the surface of the multifilament; wherein the pile refers to the short fiber with one free end and the other end bonded to the multifilament by mutual interlacing, wrapping and/or tangling; along the length direction of multifilaments, a distribution density of the pile is 120-390/m.

The following preferred technology program is presented to give a detailed description for this invention:

The said pile yarn, is measured by the image method, i.e., the pile yarn is photographed and processed, the length of the short fibers exposed from the outermost monofilament surface of the multifilament is analyzed, and the average value thereof is measured; wherein the average length of short fibers exposed from the outermost monofilament surface of the multifilament is 3-5 mm.

The present invention also provides a method for preparing a pile fabric, using the above pile yarn as all or part of raw materials, processing according to a general processing technology to prepare the pile fabric; wherein the general processing technology is a technology which does not contain an electrostatic flocking or pile cutting procedure.

The following preferred technology program is presented to give a detailed description for this invention:

The said method for preparing a pile fabric, when the processing technology is a weaving process, the pile yarn is only a weft yarn, and generally cannot be used as a warp yarn, because the pile yarn has the pile on the surface, when it is used as a warp yarn, the pile on the surface of the pile yarn will become entangled with each other under the action of heald frames and steel buckles, resulting in an unclear position of weaving, affecting the quality of weaving. Therefore, it is generally used as a weft yarn.

The present invention also provides a preparation device for a pile yarn, comprising a nozzle, a high-pressure airflow jetting device, a short fiber transferring device and a multifilament transferring device;

wherein the nozzle is cylindrical in shape as a whole, and includes an inner cylindrical tube, an outer cylindrical tube and two annular sealing rings, the inner cylindrical tube is sleeved in the outer cylindrical tube and the two are coaxial; the top ends of the inner cylindrical tube and the outer cylindrical tube are flush and connected by an annular sealing ring, and the bottom ends are flush and connected by an annular sealing ring;

wherein the outer cylindrical tube is provided with a through hole I and a through hole II, one end of through holes I and II intersects with the outer wall of the outer cylindrical tube, and the intersection points are respectively recorded as point a and point b; the other end of through holes I and II intersects with the inner wall of the outer cylindrical tube, and the intersection points are respectively recorded as point d and an additional point; through holes I and II are arranged in intervals from bottom to top along the height direction of the outer cylindrical tube;

wherein the inner cylindrical tube is provided with n groups of through holes IV, n is 4-5, each group contains 5-8 through holes IV, one end of each through hole IV intersects with the outer wall of the inner cylindrical tube, and the intersection point is recorded as point p; the other end of each through hole IV intersects with the inner wall of the inner cylindrical tube, the intersection point is recorded as point q, and point p is located below point q along the height direction of the inner cylindrical tube; the first to n-th groups of through holes IV are arranged in intervals from bottom to top along the height direction of the inner cylindrical tube; the angle between the central axis of each through hole IV and the central axis of the inner cylindrical tube is 85-90°;

wherein the inlet of through hole I (i.e. point a) and the inlet of through hole II (i.e. point b) are both connected to the high-pressure airflow jetting device, which is used to provide the high-pressure airflow, and the pressure of the high-pressure airflow and the size of the nozzle cooperate with each other so that the pressure in through holes IV is 1-2 MPa;

wherein the through hole I serves as the fiber transfer channel of short fibers, the short fiber transferring device is located on the side of the through hole I and is used to transfer short fibers to the through hole I; the hollow portion of the inner cylindrical tube serves as the fiber transfer channel of multifilaments, with its bottom end being an inlet and its top end being an outlet, and the multifilament transferring device is used to transfer multifilaments to the hollow portion of the inner cylindrical tube, and the number of monofilaments in the multifilaments is 30-50; wherein the through hole II serves as the air replenishing through hole, jetting the high-pressure airflow inward to keep the airflow inside the air cavity (that is, the portion surrounded by the outer cylindrical tube, the inner cylindrical tube and two annular sealing rings) at a certain speed and pressure.

The said through hole I and the said through hole II can ensure that: under the action of airflow, the short fibers are fed into the air cavity through the fiber transfer channel of short fibers at an initial speed in a certain direction; the short fibers fed into the air cavity will rotate along the air cavity under the action of airflow and flow forward, and in the process of rotating and flowing forward, the short fibers will enter into the fiber transfer channel of multifilaments through the through hole IV under the action of airflow; under the action of the airflow, monofilaments in the multifilaments in the fiber transfer channel of multifilaments will be entangled and transferred with each other, and will be combined with short fibers in the process of entanglement and transfer, thereby forming the pile yarn;

the present invention make the through hole I in the nozzle to be connected to the air cavity instead of being directly connected to the fiber transfer channel of multifilaments for two main purposes: firstly, as the fiber transfer channel of short fibers, when the through hole I is directly connected to the fiber transfer channel of multifilaments, the distribution of fibers will be uneven, and the uniformity of pile distribution will be difficult to control during flocking; when the short fibers enter the air cavity first, and then are dispersed into the fiber transfer channel of multifilaments through multiple through holes IV, the uniformity of the pile after flocking will be improved; secondly, the short fibers can be fully accelerated in the air cavity, and the bonding fastness of the pile after flocking will be higher.

The following preferred technology program is presented to give a detailed description for this invention:

The said preparation device for a pile yarn, wherein the central axes of through hole I and through hole II are parallel to each other (so as to ensure that the directions of the airflow fed by through hole I and through hole II are consistent, so that the fed short fibers are better accelerated under the action of the airflow), and do not intersect with the central axis of the outer cylindrical tube (that is, the extension direction of through hole I does not face the central axis of the outer cylindrical tube, so that the short fibers can be better accelerated).

The said preparation device for a pile yarn, there is a point g on the central axis of the outer cylindrical tube, the line connecting point a and point d and the line connecting point a and point g are located on the same plane perpendicular to the central axis of the outer cylindrical tube and form an angle of 5-10°.

The said preparation device for a pile yarn, wherein the outer cylindrical tube is also provided with a through hole III, one end of the through hole I intersects with the outer wall of the outer cylindrical tube, and the intersection point is recorded as point c; the other end of the through hole III intersects with the inner wall of the outer cylindrical tube, and the intersection point is recorded as point f; the through hole I, the through hole II and the through hole III are arranged in intervals from bottom to top along the height direction of the outer cylindrical tube; the through hole III is used to prevent short fibers from blocking the through hole IV;

wherein the inlet of through hole III (i.e. point c) is connected to the high-pressure airflow jetting device; wherein the high-pressure airflow jetting device respectively provides airflows of 1-2 MPa, 0.5-0.8 MPa, and 0.2-0.3 MPa to through hole J, through hole II, and through hole III.

The said preparation device for a pile yarn, wherein the inner radius of the outer cylindrical tube is 2.5-4 L, the wall thickness is 1.2-2 L, the height is 4-6 L, and L is the average length of the short fibers; wherein through hole I, through hole II, and through hole III are all circular through holes, the diameter of through hole I is 3-5 mm, the diameter of through hole II is 3-5 mm, and the diameter of through hole III is 1-3 mm; wherein the distances between the centers of point d, the additional point, and point f and the bottom end of the outer cylindrical tube are respectively 6-10 mm, 46-50 mm, and 86-106 mm.

The said preparation device for a pile yarn, wherein the inner diameter of the inner cylindrical tube is 0.2-0.5 L, and the wall thickness is 1.2-2 L; n groups of through holes IV are all circular through holes, and the diameters are all 1-2 mm; wherein the distance between the centers of two adjacent groups of through holes IV in the first to n-th groups of through holes IV is 25-30 mm, and the distance between the center of the first group of through holes IV and the bottom end of the inner cylindrical tube is 10-15 mm; wherein the pressure of the air flow in through holes I, II and HI, the diameters of through holes I, H, III and IV, and the inner diameter of the inner cylindrical tube cooperate with each other so that the pressure in through hole IV is 1-2 MPa.

The said preparation device for a pile yarn, wherein the number of through holes III is the same as the number of through holes IV in the n-th group of through holes IV, each through hole III corresponds to each through hole IV in the n-th group of through holes IV one by one, and the central axes coincide with each other; the function is that because most of short fibers have been transferred into the channels of multifilaments after the transfer of the previous groups of through holes IV, when through holes Ill correspond to the n-th group of through holes IV one by one and their central axes coincide with each other, the short fibers can be better transferred into the through holes IV under the action of the airflow in the through holes III, thereby avoiding the short fibers from being blocked between the inner cylindrical tube and the outer cylindrical tube.

The said preparation device for a pile yarn, wherein the same group of through holes IV are evenly distributed around the central axis of the inner cylindrical tube.

The said preparation device for a pile yarn, wherein the first group of through holes IV are located above through holes I along the height direction of the inner cylindrical tube and the outer cylindrical tube (so that the short fibers entering from through holes I can be made to enter through holes IV in a better way).

The said preparation device for a pile yarn, wherein the short fiber transferring device is a three-roller drafting device, consisting of back, middle and front of three rollers arranged sequentially along the fiber running direction and the corresponding back, middle and front of leather rollers; the linear speed of the front roller is 8-15 m/min, the total drafting multiple of the three-roller drafting device is 5-30 times, and the quantitative amount of short fiber strips is 5-8 g/10 m; the jetting device of the high-pressure airflow device is installed at the front roller jaw of the short fiber transferring device, and is directed to the through hole I; the fiber output from the front roller of the short fiber transferring device is subjected to the action of the airflow from the jetting device of the high-pressure airflow device after it is released from the control of the front roller jaw, and then enters into the through-hole I.

The said preparation device for a pile yarn, wherein the multifilament transferring device includes a feeding roller and a yarn drawing roller, the feeding roller is located in the lower part of the inner cylindrical tube, and the yarn drawing roller is located in the upper part of the inner cylindrical tube; wherein the linear speed ratio of the feeding roller to the yarn drawing roller is 1.01-1.05, when the linear speed of the feeding roller is faster than that of the yarn drawing roller, under the action of the airflow, not only nanofilaments in the filaments will be entangled with each other, but also the filament as a whole will roll and rotate, so the pile effect will be better, and the bonding fastness of the filament and the short fiber will be higher; wherein the linear speed of the feeding roller is 20-40 in/min, the linear speed of the feeding roller is mainly related to the density of the pile and the feeding amount of the short fiber when forming the pile, which will affect the density distribution of the short fiber (i.e. the pile) in the pile yarn.

The principle of the present invention is: in the multifilaments fed by the filament channel, the monofilaments in the multifilaments will transfer and entangle with each other, after short fibers being injected into the filament channel from hole IV, the short fibers have a certain initial speed and will transfer together with the monofilaments in the multifilaments under the action of the airflow, so the short fibers will be entangled with the monofilaments in the multifilaments during the transfer process, a part of the short fibers will be wrapped on the surface of the multifilaments, and one end of another part of the short fibers will be entangled and interlaced with the monofilaments in the multifilaments while the other end will be exposed from the surface of the multifilaments, to form the pile yarn. The mechanism of forming the pile of this invention is different from the mechanism of forming the pile of the prior art, forming the pile of the prior art is on the basis of fabrics, for example, electrostatic flocking relies on technical treatment to plant short fibers on the fabric to form the pile fabric, and the pile cutting procedure is to obtain the pile fabric by cutting the fabric; the present invention is to make a pile yarn, and use the pile yarn as a weft yarn to obtain a pile fabric.

Benefits (5) The method for spinning the pile yarn of the present invention can directly spin multifilaments and short fibers into pile yarns, which is simple and has a wide range of applications;

(6) The pile yarn prepared by the method for spinning the pile yarn of the present invention, during weaving, using the pile yarn of the present invention as the weft yarn can directly present the pile effect on the cloth surface without post-treatment;

(7) The pile yarn prepared by the device for the pile yarn of the present invention can enhance the bonding fastness of the pile on the fabric when performing interweaving of warp and weft yarns, and the pile is not easy to fall off, thereby simplifying the process of pile fabric production;

(8) The present invention uses the pile yarn to prepare the pile fabric, compared with the existing pile fabric production method, the process flow is shorter; comparing the performance of the pile fabric prepared by the pile yarn and the performance of the pile fabric prepared by the pile cutting method, the pile fabric prepared by the pile yarn can have a longer length of the pile; comparing the performance of the pile fabric prepared by the pile yarn and the performance of the pile fabric prepared by the electrostatic flocking method, the pile fabric prepared by the pile yarn has better air permeability and environmental protection (the pile fabric prepared by the electrostatic flocking method has poor air permeability because the pile and fabric are fixed by glue).

Figure 1:
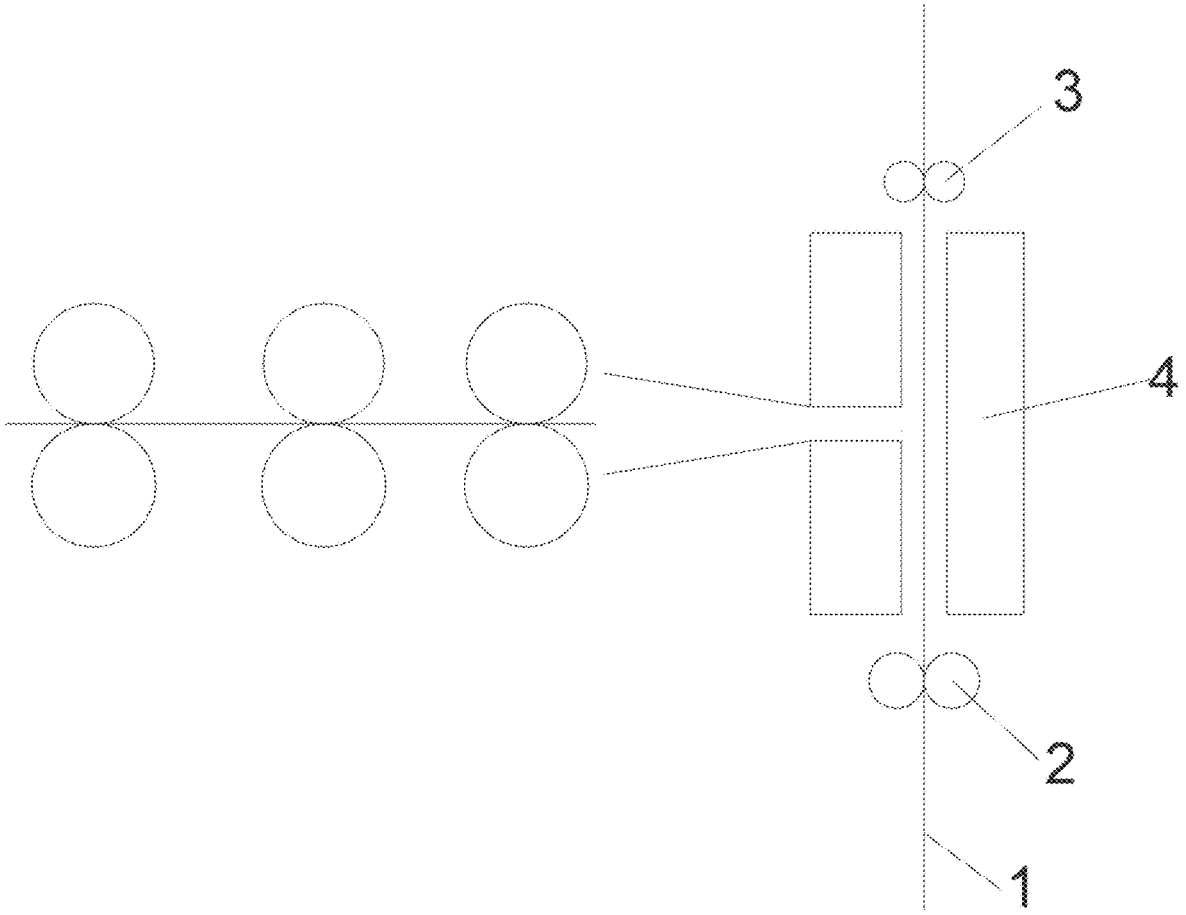
FIG. 1 is a schematic diagram of the positional relationship between the multifilament and single fiber stream feeding nozzles.

wherein the numbers in the figures are respectively represented: 1—multifilament, 2—feeding roller, 3—yarn drawing roller, 4—nozzle, 5—fiber transfer channel of multifilaments, 6—air cavity, 7—through hole IV 8—through hole I, 9—through hole II, 10—through hole III.

DETAILED DESCRIPTION OF THE EMBODIMENTS

Based on above mentioned method, the following embodiments are carried out for further demonstration in the present invention. It is to be understood that these embodiments are only intended to illustrate the invention and are not intended to limit the scope of the invention. In addition, it should be understood that after reading the contents described in the present invention, those technical personnel in this field can make various changes or modifications to the invention, and these equivalent forms also fall within the scope of the claims attached to the application.

Example 1

A method for preparing a pile yarn, the specific process is as follows:

in the process of uniform motion at 20 m/min of multifilaments, using a high-pressure airflow to feed short fibers into a fiber transfer channel of multifilaments to prepare the pile yarn;

the multifilament is a DTY filament, the specification of the DTY filament is 100D/30F; the pressure of the high-pressure airflow is 1 MPa; the included angle between the feeding direction of short fibers and the transferring direction of multifilaments is 85°;

the short fiber is a cotton fiber; the total feeding amount of short fibers is 80/s; the average length of short fibers is 15 mm;

the fiber transfer channel of multifilaments has a total of n groups of short fiber feeding points arranged at intervals along the length direction of the fiber transfer channel of multifilaments, wherein n is 4, each group contains 5 short fiber feeding points, the short fiber feeding points of the same group are evenly distributed around the central axis of the fiber transfer channel of internal multifilaments, and the distance between two adjacent groups of short fiber feeding points is 25 mm;

the prepared pile yarn mainly consists of the multifilament and piles on the surface of the multifilament; the pile refers to the short fiber with one free end and the other end bonded to the multifilament by mutual interlacing, wrapping and/or tangling; along the length direction of multifilaments, the distribution density of the pile is 240/m; the average length of short fibers exposed from the outermost monofilament surface of the multifilament is 3 mm.

Use the prepared pile yarn as the weft yarn and $32^s$ cotton yarn as the warp yarn, process according to the weaving process to obtain the pile fabric; the pile fabric is a plain weave with a warp density of 120 pieces/10 cm, and a weft density of 150 pieces/10 cm.

Example 2

A method for preparing a pile yarn, the specific process is as follows:

in the process of uniform motion at 25 m/min of multifilaments, using a high-pressure airflow to feed short fibers into a fiber transfer channel of multifilaments to prepare the pile yarn;

the multifilament is a DTY filament, the specification of the DTY filament is 100D/30F; the pressure of the high-pressure airflow is 1 MPa; the included angle between the feeding direction of short fibers and the transferring direction of multifilaments is 86°;

the short fiber is a cotton fiber; the total feeding amount of short fibers is 85/s; the average length of short fibers is 18 mm;

the fiber transfer channel of multifilaments has a total of n groups of short fiber feeding points arranged at intervals along the length direction of the fiber transfer channel of multifilaments, wherein n is 4, each group contains 6 short fiber feeding points, the short fiber feeding points of the same group are evenly distributed around the central axis of the fiber transfer channel of internal multifilaments, and the distance between two adjacent groups of short fiber feeding points is 26 mm;

the prepared pile yarn mainly consists of the multifilament and piles on the surface of the multifilament; the pile refers to the short fiber with one free end and the other end bonded to the multifilament by mutual interlacing, wrapping and/or tangling; along the length direction of multifilaments, the distribution density of the pile is 204/m; the average length of short fibers exposed from the outermost monofilament surface of the multifilament is 3.5 mm.

Use the prepared pile yarn as the weft yarn and $28^s$ cotton yarn as the warp yarn, process according to the weaving process to obtain the pile fabric; the pile fabric is a plain weave with a warp density of 110 pieces/10 cm, and a weft density of 150 pieces/10 cm.

Example 3

A method for preparing a pile yarn, the specific process is as follows:

in the process of uniform motion at 30 m/min of multifilaments, using a high-pressure airflow to feed short fibers into a fiber transfer channel of multifilaments to prepare the pile yarn;

the multifilament is a DTY filament, the specification of the DTY filament is 100D/30F; the pressure of the high-pressure airflow is 1 MPa; the included angle between the feeding direction of short fibers and the transferring direction of multifilaments is 87°;

the short fiber is a viscose fiber; the total feeding amount of short fibers is 95/s; the average length of short fibers is 18 mm;

the fiber transfer channel of multifilaments has a total of n groups of short fiber feeding points arranged at intervals along the length direction of the fiber transfer channel of multifilaments, wherein n is 4, each group contains 7 short fiber feeding points, the short fiber feeding points of the same group are evenly distributed around the central axis of the fiber transfer channel of internal multifilaments, and the distance between two adjacent groups of short fiber feeding points is 27 mm;

the prepared pile yarn mainly consists of the multifilament and piles on the surface of the multifilament; the pile refers to the short fiber with one free end and the other end bonded to the multifilament by mutual interlacing, wrapping and/or tangling; along the length direction of multifilaments, the distribution density of the pile is 190/m; the average length of short fibers exposed from the outermost monofilament surface of the multifilament is 3.5 mm.

Use the prepared pile yarn as the weft yarn and $32^s$ cotton yarn as the warp yarn, process according to the weaving process to obtain the pile fabric; the pile fabric is a plain weave with a warp density of 120 pieces/10 cm, and a weft density of 150 pieces/10 cm.

Example 4

A method for preparing a pile yarn, the specific process is as follows:

in the process of uniform motion at 35 m/min of multifilaments, using a high-pressure airflow to feed short fibers into a fiber transfer channel of multifilaments to prepare the pile yarn; the multifilament is a DTY filament, the specification of the DTY filament is 100D/30F; the pressure of the high-pressure airflow is 2 MPa; the included angle between the feeding direction of short fibers and the transferring direction of multifilaments is 88°;

the short fiber is a polyester fiber; the total feeding amount of short fibers is 100/s; the average length of short fibers is 20 mm;

the fiber transfer channel of multifilaments has a total of n groups of short fiber feeding points arranged at intervals along the length direction of the fiber transfer channel of multifilaments, wherein n is 5, each group contains 8 short fiber feeding points, the short fiber feeding points of the same group are evenly distributed around the central axis of the fiber transfer channel of internal multifilaments, and the distance between two adjacent groups of short fiber feeding points is 28 nm;

the prepared pile yarn mainly consists of the multifilament and piles on the surface of the multifilament; the pile refers to the short fiber with one free end and the other end bonded to the multifilament by mutual interlacing, wrapping and/or tangling; along the length direction of multifilaments, the distribution density of the pile is 171/m; the average length of short fibers exposed from the outermost monofilament surface of the multifilament is 4 mm.

Use the prepared pile yarn as the raw material, process according to the weft knitting process to obtain a weft knitted fabric with a plain weft needle structure, that is, the pile fabric; the transverse stitch density of the fabric is 15 wales/5 cm, and the longitudinal stitch density of the fabric is 15 courses/5 cm.

Example 5

A method for preparing a pile yarn, the specific process is as follows:

in the process of uniform motion at 40 m/min of multifilaments, using a high-pressure airflow to feed short fibers into a fiber transfer channel of multifilaments to prepare the pile yarn;

the multifilament is a DTY filament, the specification of the DTY filament is 100D/30F; the pressure of the high-pressure airflow is 2 MPa; the included angle between the feeding direction of short fibers and the transferring direction of multifilaments is 89°;

the short fiber is a wool fiber; the total feeding amount of short fibers is 115/s; the average length of short fibers is 25 mm;

the fiber transfer channel of multifilaments has a total of n groups of short fiber feeding points arranged at intervals along the length direction of the fiber transfer channel of multifilaments, wherein n is 5, each group contains 7 short fiber feeding points, the short fiber feeding points of the same group are evenly distributed around the central axis of the fiber transfer channel of internal multifilaments, and the distance between two adjacent groups of short fiber feeding points is 29 mm;

the prepared pile yarn mainly consists of the multifilament and piles on the surface of the multifilament; the pile refers to the short fiber with one free end and the other end bonded to the multifilament by mutual interlacing, wrapping and/or tangling; along the length direction of multifilaments, the distribution density of the pile is 173/m; the average length of short fibers exposed from the outermost monofilament surface of the multifilament is 5 mm.

Use the prepared pile yarn as the raw material, process according to the weft knitting process to obtain a weft knitted fabric with a rib structure, that is, the pile fabric; the transverse stitch density of the fabric is 20 wales/5 cm, and the longitudinal stitch density of the fabric is 16 courses/5 cm.

Example 6

A method for preparing a pile yarn, the specific process is as follows:

in the process of uniform motion at 40 m/min of multifilaments, using a high-pressure airflow to feed short fibers into a fiber transfer channel of multifilaments to prepare the pile yarn;

the multifilament is a DTY filament, the specification of the DTY filament is 100D/30F; the pressure of the high-pressure airflow is 2 MPa; the included angle between the feeding direction of short fibers and the transferring direction of multifilaments is 90°;

the short fiber is a wool fiber; the total feeding amount of short fibers is 130/s; the average length of short fibers is 25 mm;

the fiber transfer channel of multifilaments has a total of n groups of short fiber feeding points arranged at intervals along the length direction of the fiber transfer channel of multifilaments, wherein n is 5, each group contains 6 short fiber feeding points, the short fiber feeding points of the same group are evenly distributed around the central axis of the fiber transfer channel of internal multifilaments, and the distance between two adjacent groups of short fiber feeding points is 30 mm;

the prepared pile yarn mainly consists of the multifilament and piles on the surface of the multifilament; the pile refers to the short fiber with one free end and the other end bonded to the multifilament by mutual interlacing, wrapping and/or tangling; along the length direction of multifilaments, the distribution density of the pile is 195/m; the average length of short fibers exposed from the outermost monofilament surface of the multifilament is 5 mm.

Use the prepared pile yarn as the raw material, process according to the warp knitting process to obtain a warp knitted fabric with a warp plain structure, that is, the pile fabric; the transverse stitch density of the fabric is 18 wales/5 cm, and the longitudinal stitch density of the fabric is 14 courses/5 cm.

Example 7

A method for preparing a pile yarn, basically the same as Example 1, except for that: the short fibers are not continuously fed into the fiber transfer channel of multifilaments, but are discontinuously fed into the fiber transfer channel of multifilaments; the discontinuous feeding is 1 second at 1 second interval; when feeding, the total feeding amount of short fibers is the same as that in Example 1.

The prepared pile yarn consists of non-pile segments and pile segments arranged alternately along the length direction; the non-pile segment only consists of multifilaments; the pile segment mainly consists of multifilaments and piles on the surface of the multifilament, the pile refers to the short fiber with one free end and the other end bonded to the multifilament by mutual interlacing, wrapping and/or tangling, along the length direction, the distribution density of the pile of the pile segment is 240/m; the average length of short fibers exposed from the outermost monofilament surface of the multifilament is 3 mm.

Use the prepared pile yarn as the weft yarn and $32^s$ cotton yarn as the warp yarn, process according to the weaving process to obtain the pile fabric; the pile fabric is a plain weave with a warp density of 120 pieces/10 cm, and a weft density of 150 pieces/10 cm.

Figure 2:
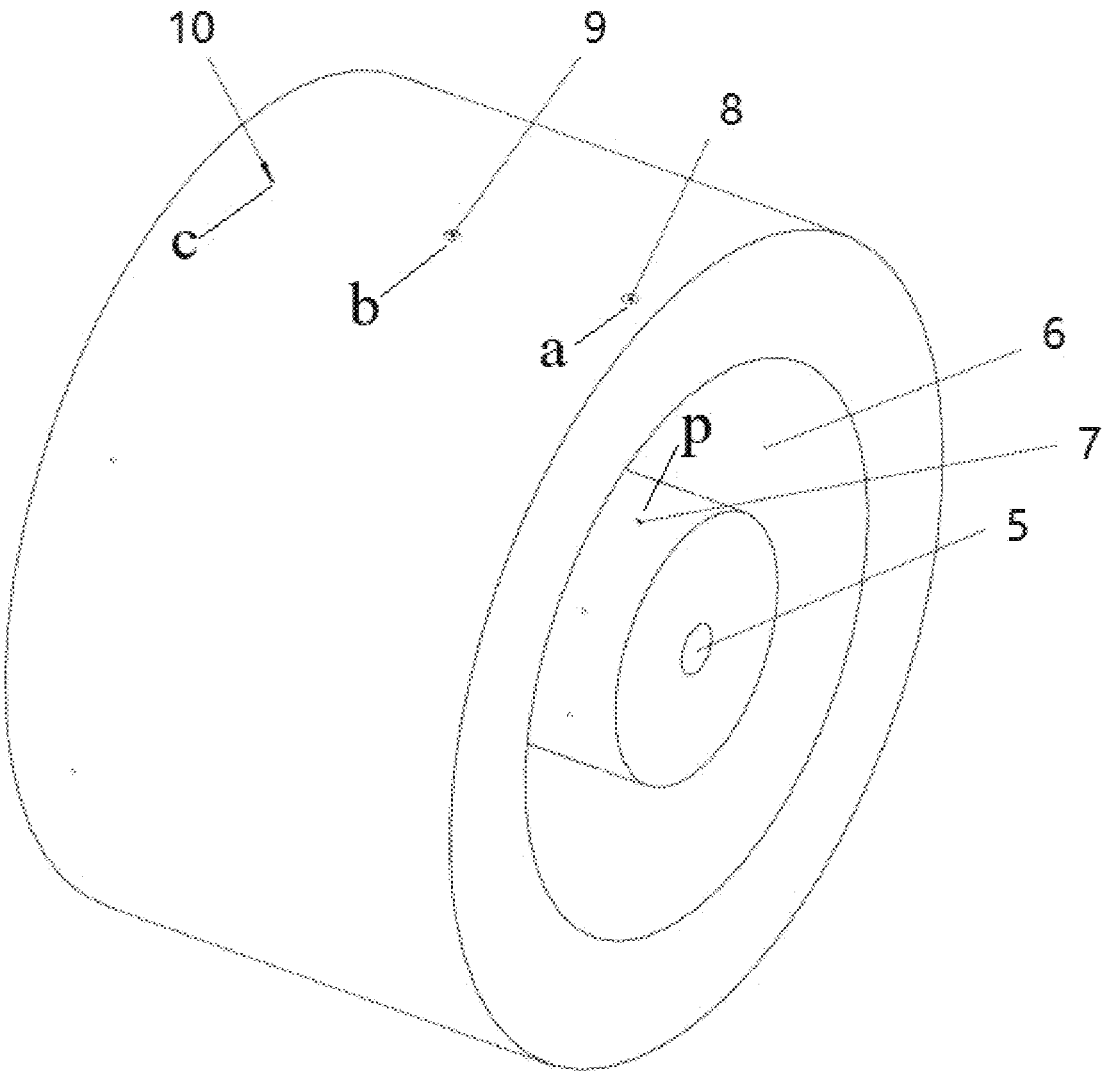
FIG. 2 is a schematic diagram of the structure of the nozzle used in the present invention.
Figure 3:
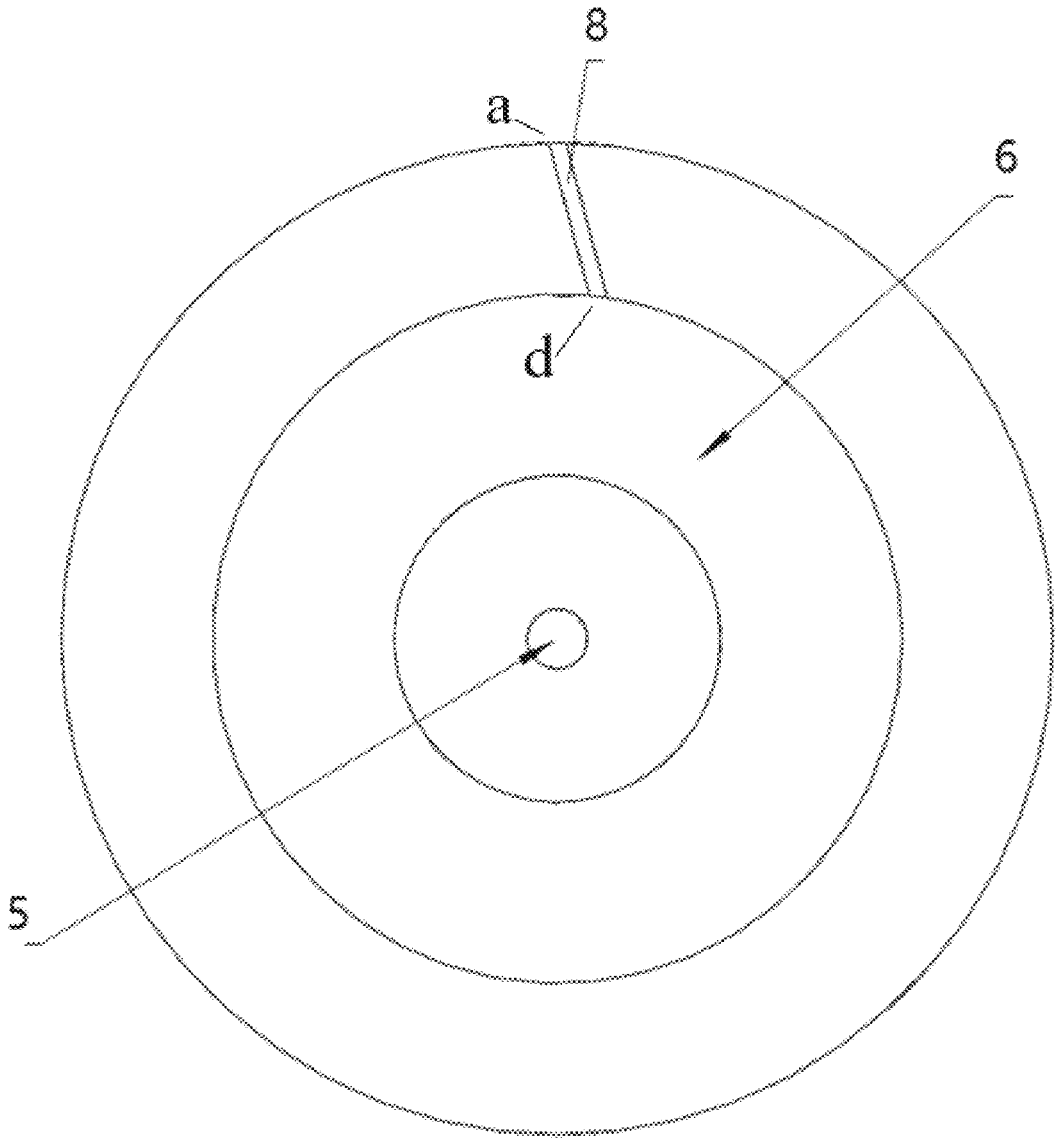
FIG. 3 is a cross-sectional schematic diagram of through hole I of the nozzle used in the present invention.
Figure 4:
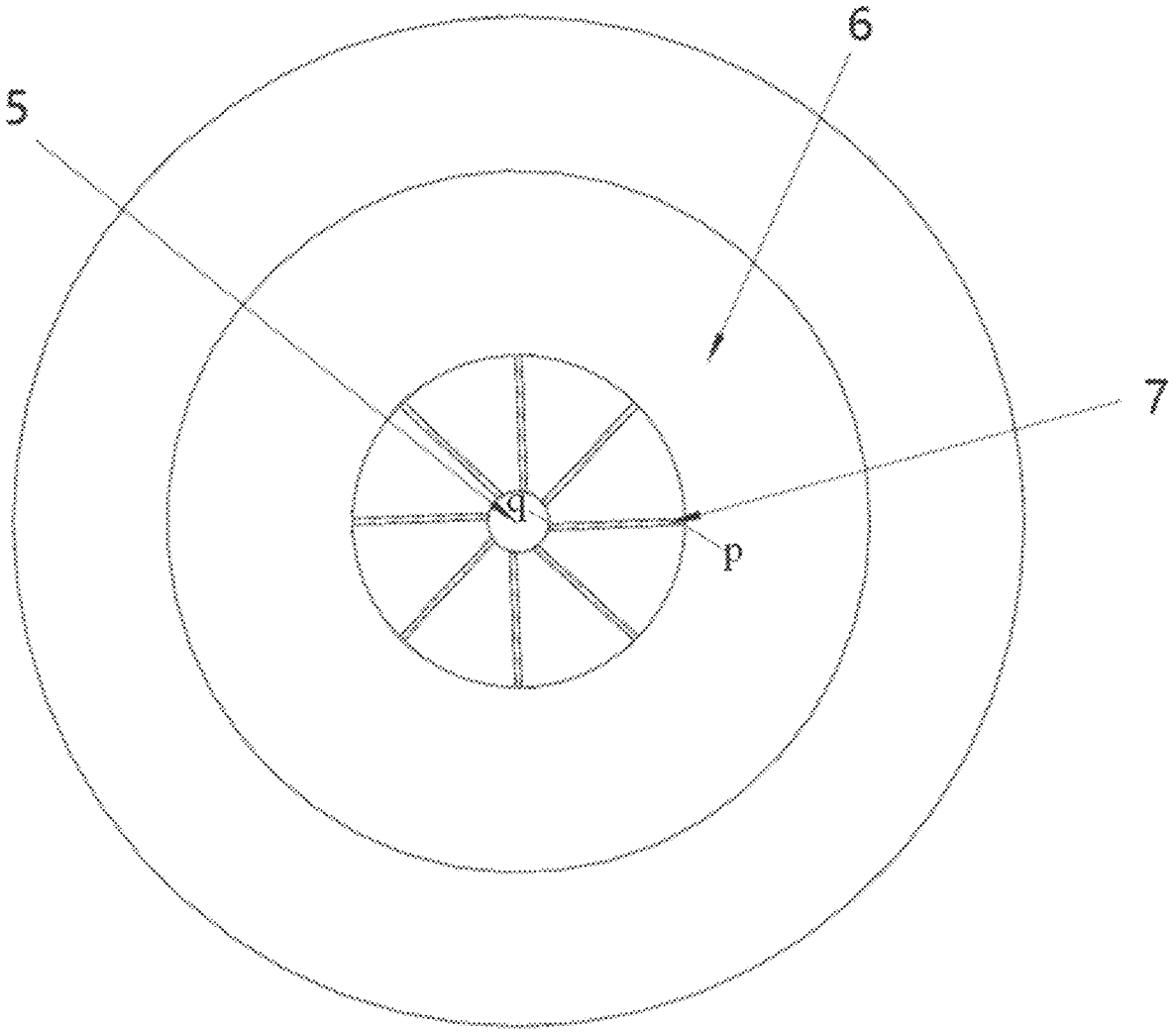
FIG. 4 is a cross-sectional schematic diagram of one group of through holes IV of the nozzle used in the present invention.
Figure 5:
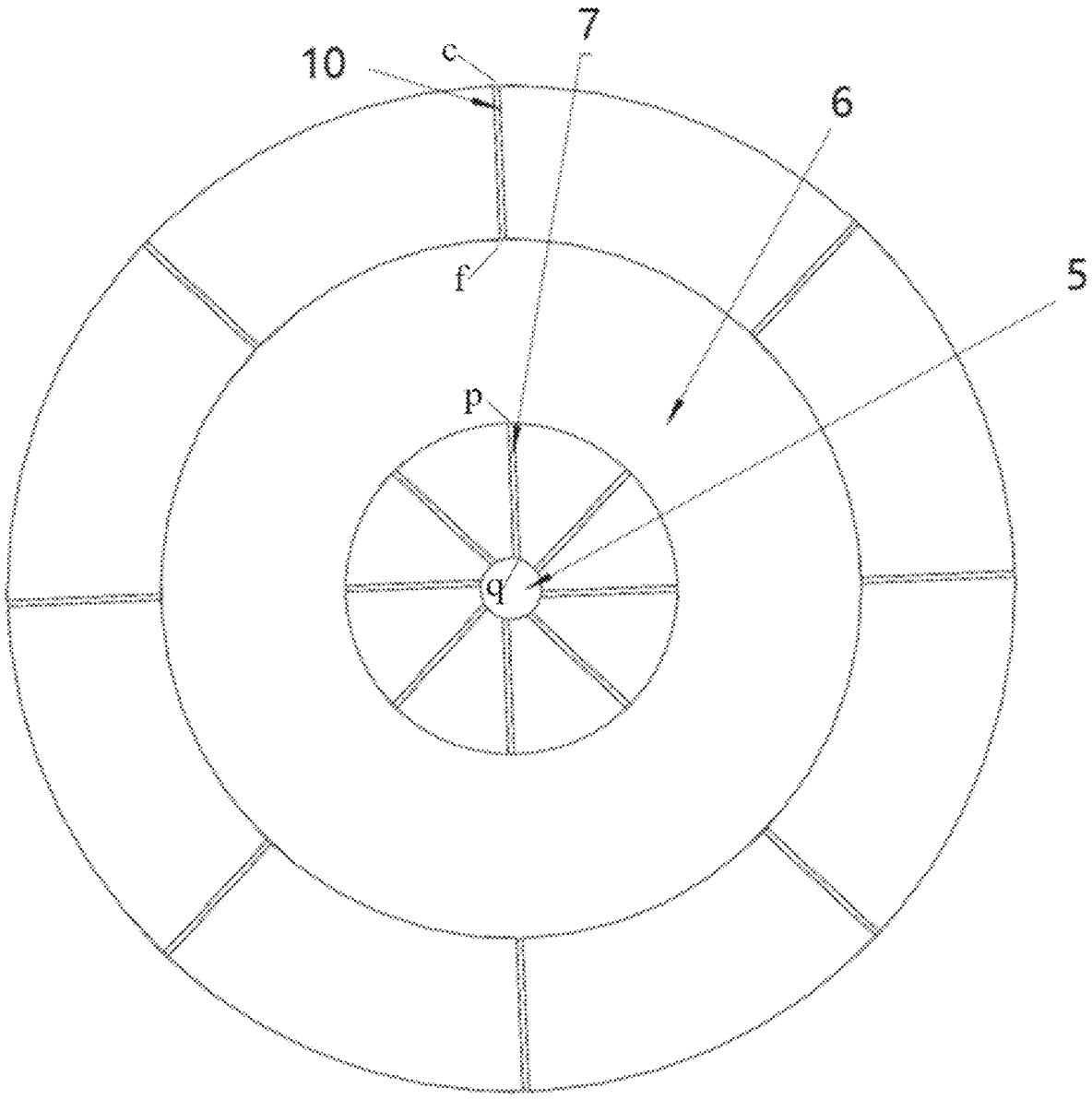
FIG. 5 is a cross-sectional schematic diagram of through hole III of the nozzle used in the present invention.

The preparation process of the pile yarn according to examples 1-7 can be realized by various devices, and the present invention only exemplarily provides a preparation device of the pile yarn, as shown in FIGS. 1-5, including a nozzle 4, a high-pressure airflow jetting device, a short fiber transferring device and a multifilament transferring device;

the short fiber transferring device is a three-roller drafting device, consisting of back, middle and front of three rollers arranged sequentially along the fiber running direction and the corresponding back, middle and front of leather rollers; the linear speed of the front roller is 8-15 m/min, the total drafting multiple of the three-roller drafting device is 5-30 times, and the quantitative amount of short fiber strips is 5-8 g/10 m; the multifilament transferring device includes a feeding roller 2 and a yarn drawing roller 3, the feeding roller 2 is located in the lower part of the inner cylindrical tube, and the yarn drawing roller 3 is located in the upper part of the inner cylindrical tube; the linear speed ratio of the feeding roller 2 to the yarn drawing roller 3 is 1.01-1.05, the linear speed of the feeding roller 2 is 20-40 m/min;

the nozzle 4 is cylindrical in shape as a whole, and includes an inner cylindrical tube, an outer cylindrical tube and two annular sealing rings, the inner cylindrical tube is sleeved in the outer cylindrical tube and the two are coaxial; the top ends of the inner cylindrical tube and the outer cylindrical tube are flush and connected by an annular sealing ring, and the bottom ends are flush and connected by an annular sealing ring, wherein the portion surrounded by the outer cylindrical tube, the inner cylindrical tube and two annular sealing rings is the air cavity 6; the outer cylindrical tube is provided with a through hole I 8, a through hole II 9, and a through hole III 10, one end of through holes I, II and III intersects with the outer wall of the outer cylindrical tube, and the intersection points are respectively recorded as point a, b and c; the other end of through holes I, II and III intersects with the inner wall of the outer cylindrical tube, and the intersection points are respectively recorded as point d, the additional point and point f; through holes I, II and III are arranged in intervals from bottom to top along the height direction of the outer cylindrical tube;

the inner cylindrical tube is provided with n groups of through holes IV 7, n is 4-5, each group contains 5-8 through holes IV 7, one end of each through hole IV 7 intersects with the outer wall of the inner cylindrical tube, and the intersection point is recorded as point p; the other end of each through hole IV 7 intersects with the inner wall of the inner cylindrical tube, the intersection point is recorded as point q, and point p is located below point q along the height direction of the inner cylindrical tube; the first to n-th groups of through holes IV 7 are arranged in intervals from bottom to top along the height direction of the inner cylindrical tube; the angle between the central axis of each through hole IV 7 and the central axis of the inner cylindrical tube is 85-90°;

the through hole I 8 serves as the fiber transfer channel of short fibers, the short fiber transferring device is located on the side of the through hole I 8 and is used to transfer short fibers to the through hole I 8; the hollow portion of the inner cylindrical tube serves as the fiber transfer channel of multifilaments 5, with its bottom end being an inlet and its top end being an outlet, and the multifilament transferring device is used to transfer multifilaments to the hollow portion of the inner cylindrical tube, and the number of monofilaments in the multifilaments 1 is 30-50;

the central axes of through hole I 8 and through hole II 9 are parallel to each other, and do not intersect with the central axis of the outer cylindrical tube; there is a point g on the central axis of the outer cylindrical tube, the line connecting point a and point d and the line connecting point a and point g are located on the same plane perpendicular to the central axis of the outer cylindrical tube and form an angle of 5-10°;

the number of through holes III 10 is the same as the number of through holes IV 7 in the n-th group of through holes IV 7, each through hole III 10 corresponds to each through hole IV 7 in the n-th group of through holes IV 7 one by one, and the central axes coincide with each other; the same group of through holes IV 7 are evenly distributed around the central axis of the inner cylindrical tube;

the inner radius of the outer cylindrical tube is 2.5-4 L, the wall thickness is 1.2-2 L, the height is 4-6 L, and L is the average length of the short fibers; wherein through hole I 8, through hole II 9, and through hole III 10 are all circular through holes, the diameter of through hole I 8 is 3-5 mm, the diameter of through hole II 9 is 3-5 mm, and the diameter of through hole III 10 is 1-3 mm; wherein the distances between the centers of point d, the additional point, and point f and the bottom end of the outer cylindrical tube are respectively 6-10 mm, 46-50 mm, and 86-106 mm;

the inner diameter of the inner cylindrical tube is 0.2-0.5 L, and the wall thickness is 1.2-2 L; n groups of through holes IV 7 are all circular through holes, and the diameters are all 1-2 mm; the distance between the centers of two adjacent groups of through holes IV 7 in the first to n-th groups of through holes IV is 25-30 mm, and the distance between the center of the first group of through holes IV 7 and the bottom end of the inner cylindrical tube is 10-15 mm;

the first group of through holes IV 7 are located above through holes I 8 along the height direction of the inner cylindrical tube and the outer cylindrical tube;

the inlet of through hole I 8 (i.e. point a), the inlet of through hole II 9 (i.e. point b) and the inlet of through hole III 10 (i.e. point c) are all connected to the high-pressure airflow jetting device, the high-pressure airflow jetting device respectively provides airflows of 1-2 MPa, 0.5-0.8 MPa, and 0.2-0.3 MPa to through hole I 8, through hole II 9, and through hole III 10; the pressure of the high-pressure airflow and the size of the nozzle 4 cooperate with each other so that the pressure in through holes IV 7 is 1-2 MPa.

Taking Example 1 as an example, how to use the device to process a pile yarn is illustrated:

The parameters of the device of the present invention are set as follows: the linear speed of the front roller is 15 m/min, the total drafting multiple of the three-roller drafting device is 10 times, and the quantitative amount of short fiber strips is 8 g/10 m; the linear speed ratio of the feeding roller 2 to the yarn drawing roller 3 is 1.01, the linear speed of the feeding roller 2 is 20 m/min; n is 4, each group contains 5 through holes IV 7; the angle between the central axis of each through hole IV 7 and the central axis of the inner cylindrical tube is 85°; the line connecting point a and point d and the line connecting point a and point g are located on the same plane perpendicular to the central axis of the outer cylindrical tube and form an angle of 5°;

the inner radius of the outer cylindrical tube is 2.5 L, the wall thickness is 2 L, the height is 6 L, and L is the average length of the short fibers, which is 15 mm; wherein through hole I 8, through hole II 9, and through hole III 10 are all circular through holes, the diameter of through hole I 8 is 5 mm, the diameter of through hole II 9 is 5 mm, and the diameter of through hole III 10 is 3 mm; wherein the distances between the centers of point d, the additional point, and point f and the bottom end of the outer cylindrical tube are respectively 10 mm, 50 mm, and 106 mm;

the inner diameter of the inner cylindrical tube is 0.5 L, and the wall thickness is 2 L; n groups of through holes IV 7 are all circular through holes, and the diameters are all 2 mm; the distance between the centers of two adjacent groups of through holes IV 7 in the first to n-th groups of through holes IV is 25 mm, and the distance between the center of the first group of through holes IV 7 and the bottom end of the inner cylindrical tube is 12 mm; the inlet of through hole I 8 (i.e. point a), the inlet of through hole II 9 (i.e. point b) and the inlet of through hole III 10 (i.e. point c) are all connected to the high-pressure airflow jetting device, the high-pressure airflow jetting device respectively provides airflows of 2 MPa, 0.8 MPa, and 0.3 MPa to through hole I 8, through hole I 9, and through hole III 10; the pressure of the high-pressure airflow and the size of the nozzle 4 cooperate with each other so that the pressure in through holes IV 7 is 1 MPa;

The preparation process of the pile yarn is as follows: use the multifilament transferring device to transfer multifilaments to the hollow portion of the inner cylindrical tube (that is, the fiber transfer channel of multifilaments 5), use the short fiber transferring device to transfer short fibers to the through hole I 8, and use the high-pressure airflow provided by the high-pressure airflow jetting device to continuously feed short fibers into the fiber transfer channel of multifilaments 5 to prepare the pile yarn;

wherein the multifilament is a DTY filament, the specification of the DTY filament is 100D/30F;

the short fiber is a cotton fiber; the total feeding amount of short fibers feeding into the fiber transfer channel of multifilaments 5 is 80/s.

The prepared pile yarn mainly consists of the multifilament and piles on the surface of the multifilament; the pile refers to the short fiber with one free end and the other end bonded to the multifilament by mutual interlacing, wrapping and/or tangling; along the length direction of multifilaments, the distribution density of the pile is 240/m; the average length of short fibers exposed from the outermost monofilament surface of the multifilament is 3 mm.

The invention claimed is:

1. A method for preparing a pile yarn, comprising:

in a process of a motion of a multifilament including multiple monofilaments, using a high-pressure airflow to feed short fibers into a fiber transfer channel of the multifilament at a uniform speed to prepare the pile yarn, wherein an average length of the short fibers is 15-25 mm;

wherein a number of monofilaments in the multifilament is 30-50;

wherein a pressure of the high-pressure airflow is 1-2 MPa; and wherein an included angle of 85-90° is formed between a feeding direction of the short fibers and a transferring direction of the multifilament, wherein the pile yarn comprises the multifilament and piles on a surface of the multifilament; wherein each of the piles includes a given short fiber of the short fibers, said given short fiber having a first end and a second end, wherein the first end is a free end, and the second end is bonded to the multifilament by a mutual interlacing, a wrapping, and/or a tangling, wherein an average exposure length of the short fibers is 3-5 mm, wherein an exposure length defines a length of a portion of a corresponding short fiber of the short fibers that is exposed from an outermost monofilament surface of the multifilament.

2. The method according to claim 1, wherein the multiple monofilaments are a draw textured yarn (DTY); wherein a specification of the draw textured yarn is 100-150 D/30-50 F.

3. The method according to claim 1, wherein the uniform speed of the motion is between 20-40 m/min.

4. The method according to claim 1, wherein a total number of strands of the short fibers fed per second is 80-130.

5. The method according to claim 4, wherein each of the short fibers is a cotton fiber, a viscose fiber, a polyester fiber, or a wool fiber.

6. The method according to claim 4, wherein the fiber transfer channel of the multifilament has a total of n groups of short fiber feeding points arranged at intervals along a length direction of the fiber transfer channel of the multifilament, wherein n is 4-5, each of the n groups contains 5-8 short fiber feeding points, short fiber feeding points of a same group are evenly distributed around a central axis of the fiber transfer channel, and a distance between two adjacent groups of the short fiber feeding points is 25-30 mm.

7. The method according to claim 1, wherein a feeding of the short fibers is a continuous feeding or a discontinuous feeding.

* * * * *